US006307508B1

(12) United States Patent
Nagasawa

(10) Patent No.: US 6,307,508 B1
(45) **Date of Patent: *Oct. 23, 2001**

(54) FLAT ANTENNA

(75) Inventor: Satoshi Nagasawa, Mobara (JP)

(73) Assignee: Futaba Denshi Kogyo Kabushiki Kaisha, Mobara (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/158,782

(22) Filed: Sep. 23, 1998

(30) Foreign Application Priority Data

Sep. 26, 1997 (JP) ..... 09-261343

(51) Int. Cl.[7] ..... H01Q 1/38
(52) U.S. Cl. ..... 343/700 MS
(58) Field of Search ..... 343/700 MS, 846, 343/848

(56) References Cited

U.S. PATENT DOCUMENTS 4,160,976 * 7/1979 Conroy ..... 343/700 MS
4,218,682 * 8/1980 Yu ..... 343/700 MS
4,386,357 * 5/1983 Patton ..... 343/700 MS

* cited by examiner

*Primary Examiner*—Tan Ho
(74) *Attorney, Agent, or Firm*—Oblon, Spivak, McClelland, Maier & Neustadt, P.C.

(57) ABSTRACT

A flat antenna with a simplified feeder point is provided. The flat antenna consists of a round patch antenna section, a dielectric material, a grounded conductive plate. The patch antenna section is arranged so as to confront the grounded conductive plate via the dielectric material. The center conductor of a coaxial cable is inserted into the opening formed in the grounded conductive plate and further penetrates the dielectric material of a thickness of t. The center conductor is electrically connected with the feeder point P of the patch antenna section. The outer conductor of the coaxial cable is connected to the grounded conductive plate. The center conductor has the inductive impedance L added by the penetration length of the dielectric material. Improved matching characteristics can be provided by setting the resonance frequency of the patch antenna section to a higher frequency than receive frequencies and by adding a capacitive impedance to the impedance of the feeder point.

3 Claims, 3 Drawing Sheets

FLAT ANTENNA

BACKGROUND OF THE INVENTION

1. Field of the Invention

This invention relates to a flat antenna, and more particularly to an improved feeding method suitable for a coaxial cable connected to the feeder point of a flat antenna.

2. Description of the Related Art

Recently, simple flat antennas which can be manufactured at low costs have been developed as widespread antennas for the mobile communication system.

The flat antenna or thin antenna is configured, for example, by disposing a patch conductor cut to a predetermined size over a grounded conductive plate through a dielectric material. This structure allows an antenna with high sensitivity over several GHz rf waves to be fabricated in a relatively simple structure. Such an antenna can be easily mounted to appliances.

However, a problem arises in using the flat antenna resonating at a receive frequency and in designing a radiation resistance, or the impedance at the feeder point having a real-part component. That is, when received rf waves are taken out of the antenna or the coaxial cable for supplying transmission power to the antenna is connected to the patch antenna, various kinds of machining are required to match the impedance of the feeder point.

The above-mentioned problem will be described below with reference to FIG. 5. FIG. 5(*a*) is a cross sectional view partially illustrating a flat antenna. Referring to FIG. 5(*a*), numeral 10 represents a patch antenna section made of a conductive plate sized so as to resonate to a received frequency, 11 represents a dielectric material, and 12 represents a grounded conductive plate.

Numeral 13 represents a center conductor of a coaxial cable disposed to feed power to the patch antenna section 10. The outer conductor of the coaxial cable is grounded within the opening 12A of the grounded conductive plate 12.

The dielectric material 11 with a high dielectric constant is used to miniaturize the antenna. A thick dielectric material 11 of a large thickness generally provides a higher receive sensitivity and a wider receive band.

However, the center conductor 13 inserted into the dielectric material 11 induces an inductive impedance component L at the opening. In designing, the impedance at the feeder point of the patch antenna resonating at a specific receive frequency is usually set to have only a radiation resistance component. Hence, in order to cancel the inductive impedance L added to the terminal impedance of the coaxial cable, the center conductor 13 of the coaxial cable is disposed to pass though the feeder point of the patch antenna, as shown in FIG. 5, and the tip thereof is connected to a chip conductor 15. The coaxial cable is matched with the patch antenna by means of the capacitive impedance C formed between the chip conductor 15 and the patch antenna section 10.

FIG. 5(*b*) shows a circular patch antenna in which like elements are represented with like numerals as shown in FIG. 5(*a*). In the case of the conventional structure shown in FIG. 5(*b*), in order to cancel the inductive impedance L added by the center conductor 13 of the coaxial cable penetrating the dielectric material, an island conductor 10B insulated from the patch antenna is disposed at the feeder point of the patch antenna 10A. The patch antenna 10A is matched with the coaxial cable by means of the capacitance C defined by the gap t between the island conductor 10B and the patch antenna 10A.

Referring to FIG. 5(*c*), an insulating material 15 is disposed between the patch antenna portion 10 and the dielectric material 11. The center conductor 13 of the coaxial cable is connected to the chip conductor 16 disposed underneath the insulating layer 15. Thus, the matching configuration which cancels the inductive impedance L is provided by adding the capacitive impedance C between the chip conductor 16 and the patch antenna section 10.

As described above, in order to feed power with the coaxial cable, the conventional flat antenna is electrically matched to cancel the inductive impedance L of the center conductor penetrating the dielectric material 12. Hence, the problem is that the patch antenna section must be machined to some degree so that the structure of the flat antenna is complicated.

SUMMARY OF THE INVENTION

The present invention is made to overcome the above-mentioned problems. The object of the invention is to provide a simplified flat antenna which can reduce fabrication costs.

According to the present invention, the flat antenna comprises a patch antenna section which is set to resonate at a predetermined frequency; a dielectric plate having one surface in contact with the patch antenna section and the other surface in contact with a grounded plate; and a coaxial feeder connected to the patch antenna section through both the grounded plate and the dielectric plate; the coaxial feeder having its center conductive portion which penetrates the dielectric plate and is connected to a feeder point of the patch antenna section; wherein the resonance frequency of the patch antenna section is set to a value higher than receive frequencies in such a manner that an inductive impedance component of said center conductive portion is nearly equal to a capacitive impedance component of the feeder point of the patch antenna portion over use frequencies.

In the flat antenna according to the present invention, the patch antenna section comprises a circular conductive plate.

In the flat antenna according to the present invention, the patch antenna section comprises a rectangular conductive plate.

The above and other objects, features and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1A:
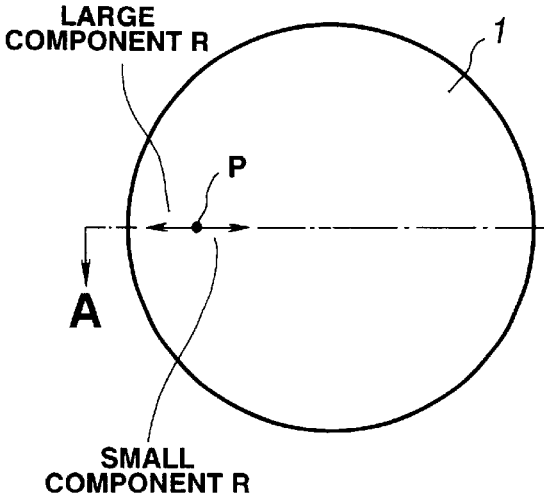
FIG. 1(*a*) is a plan view illustrating a flat antenna according to an embodiment of the present invention and FIG. 1(*b*) is a cross sectional view partially illustrating the flat antenna of FIG. 1(*a*)
Figure 1B:
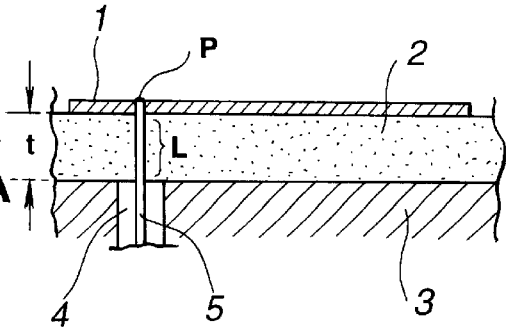

FIG. 1 is a plan view illustrating a flat antenna according to an embodiment of the present invention and a cross sectional view illustrating the flat antenna taken along the line A—A of the plan view. Referring to FIG. 1, numeral 1 represents a round patch antenna section, 2 represents a dielectric material, and 3 represents a grounded conductive plate. The patch antenna section 1 is disposed to confront the grounded conductive section 3 via the dielectric material 2. The center conductor 5 of the coaxial cable is inserted via the opening 4 of the grounded conductive plate and further penetrates the dielectric material 3 of a thickness of t.

The center conductor 5 is electrically connected at the point P of the patch antenna section 1 acting as a feeder point to transmit and receive radio waves. The outer conductor of the coaxial cable is connected to the grounded conductive portion 3.

A symbol L represents an inductive impedance added to according to the penetration length of the dielectric material 2.

Figure 2A:
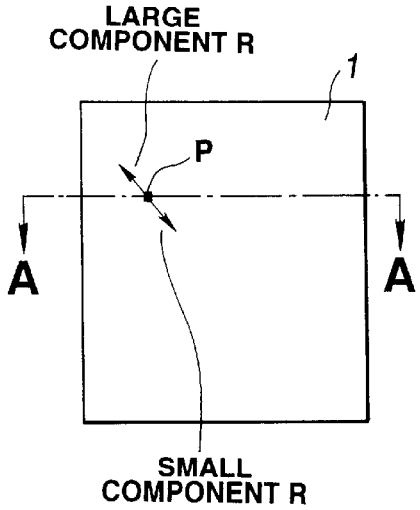
FIG. 2(*a*) is a plan view illustrating a flat antenna according to another embodiment of the present invention and FIG. 2(*b*) is a cross sectional view partially illustrating the flat antenna of FIG. 2(*a*)
Figure 2B:
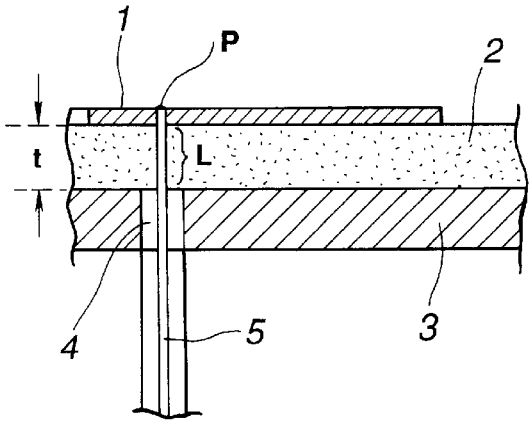

FIG. 2 is a plan view and a cross sectional view each illustrating a flat antenna according to another embodiment of the present invention. In this embodiment, a rectangular conductive plate is used as the patch antenna section 1. In FIGS. 1 and 2, like numerals represent like constituent elements.

It is known that the rectangular patch antenna section 1 having one side of a length L equal to ½ of line wavelength of the feeder resonates as a rectangular micro-strip antenna.

Generally, in the patch antenna, the end effect of the dielectric material 2 having a large thickness t equivalently decreases the antenna resonance frequency Q, thus improving the receive sensitivity.

Figure 4:
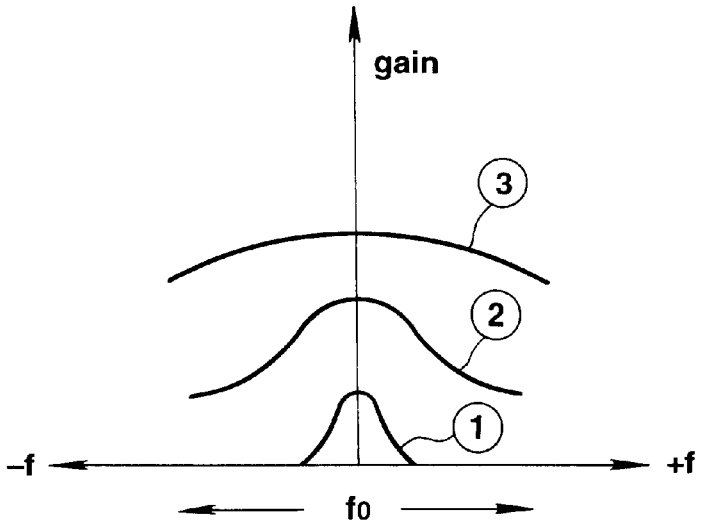
FIG. 4 is a graph showing effective gain characteristics of an antenna plotted for dielectric thickness and dielectric constant.
Figure 5A:
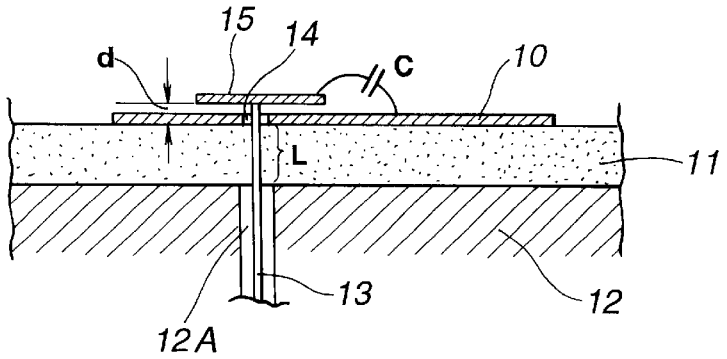
FIG.5(a) (PRIOR ART)
FIGS. 5(*a*), 5(*b*) and 5(*c*) are diagrams each illustrating an impedance matching structure used for the feeder point of a conventional flat antenna.
Figure 5B:
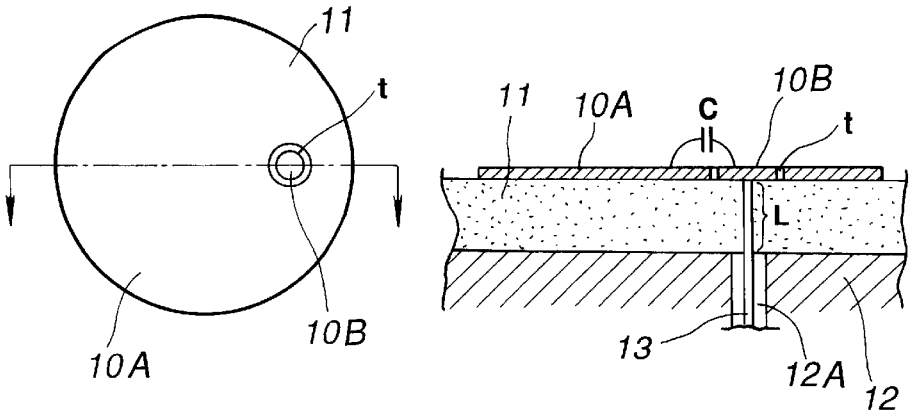
FIG.5(b) (PRIOR ART)
Figure 5C:
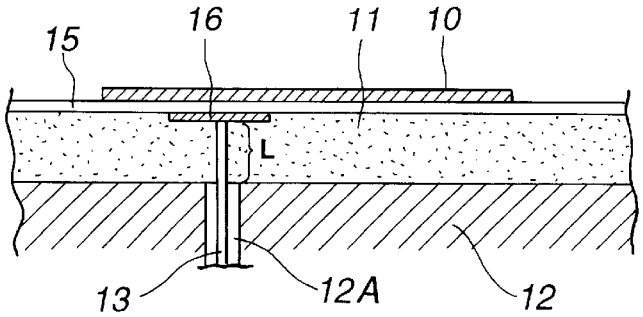
FIG.5(c) (PRIOR ART)

FIG. 4 shows effective gains of the flat antenna. As the dielectric constant $\in$ of a dielectric material increases, a sharp Q value is obtained in a receive band but the sensitivity is lowered, as shown with ① in FIG. 4. As the thickness t of the dielectric material increases, the Q value tends to decrease but the sensitivity tends to increase, as shown with ② and ③ in FIG. 4.

The position of the feeder point P can be selected according to the mode that the antenna resonates and changes the effective impedance R thereat.

For example, in the flat antenna as shown in FIG. 1, as the position of the feeder point P moves leftward, the effective impedance R increases. As the position of the feeder point P moves rightward, the effective impedance R decreases.

In the flat antenna, for example, shown in FIG. 2, the effective impedance R can be varied by moving the feeder point P in the depicted direction.

Figure 3:
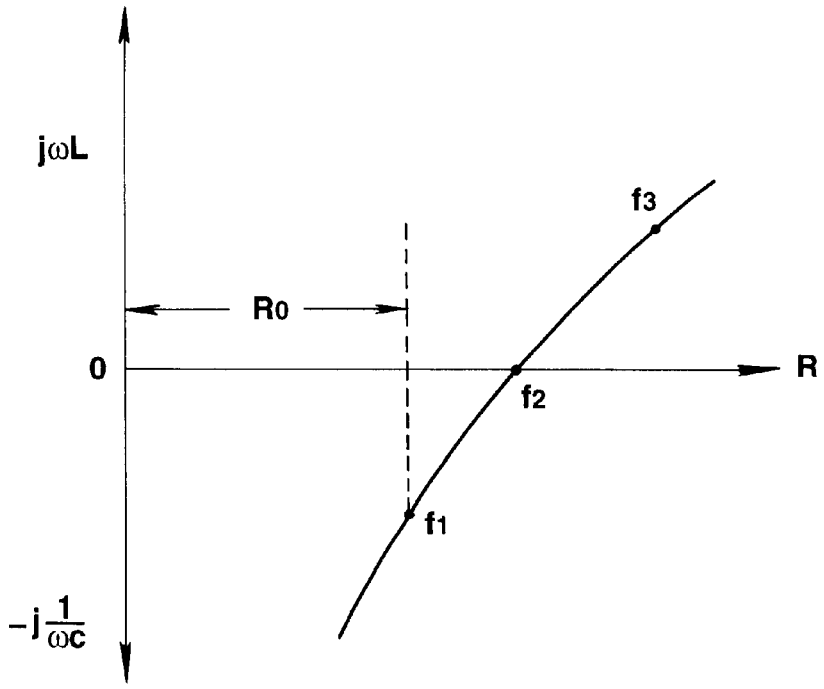
FIG. 3 is a graph plotting the impedance characteristic of the feeder point of a flat antenna.

FIG. 3 plots changes in impedance at the feeder point when a patch antenna resonating at a predetermined frequency f2 is excited with different frequencies.

As seen from FIG. 3, when the patch antenna resonating at a frequency f2 is excited with a low frequency f1, a capacitive impedance $1/j\omega C$ is added to the same feeder point. On the other hand, when the patch antenna resonating at a frequency f2 is excited with the frequency f3 higher than the frequency f2, an inductive impedance $j\omega L$ is added to the same feeder point.

The radiation resistance R depends on the position of the feeder point of the patch antenna and generally shows a higher value when the feeder point approaches the outer fringe of the patch.

In the embodiments of the present invention, the shape of the patch antenna section 1 arranged on the dielectric material 2 shown in FIGS. 1 and 2 is sized so as to resonate at a frequency somewhat higher than a predetermined receive frequency f.

The center conductor 5 penetrating the dielectric material 2 as shown in FIG. 1 or 2 is directly connected to the feeder point of the patch antenna section 1 thus designed.

When the thus-designed flat antenna is excited at a frequency f, the feeder point has a capacitive impedance. Hence, the flat antenna can be designed in such a manner that the resonance of the capacitive impedance $1/j\omega C$ and the inductive impedance $j\omega L$ of the end portion of the center conductor 5 penetrating the dielectric material 2 can be set at a receive frequency f. The impedance viewed from the feeder line side can has a resistance component with only a real part.

As described above, the matching requirements which produces no reactive power can be constructed by deciding the position of the feeder point where the resistance component agrees with the characteristic impedance of the feeder point.

For example, when the practical thickness t of the dielectric material is set to about 1/10 of the rf wavelength $\lambda$, f1/f2 is about 0.98 in the case shown in FIG. 3. It was found that the effective gain and directivity of the antenna can be hardly degraded.

The flat antenna where the center conductor of a coaxial cable can be directly connected to the patch antenna section with a soldering enables the feeder line to be easily mounted and can make the price of an antenna inexpensive.

As described above, in the flat antenna according to the present invention, a coaxial cable can be connected to a patch antenna section by directly inserting the center conductor of the coaxial cable into the dielectric material and then soldering it at the feeder point. As a result, the antenna structure can be simplified and the fabrication costs can be decreased.

There is the advantage in that the simple structure allows the antenna to be easily mounted to a mobile communication equipment and can reduce an accident by which a communication system goes down caused by failure.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A flat antenna comprising:

a patch antenna section which is set to resonate at a predetermined frequency;

a dielectric plate having one surface in contact with said patch antenna section and another surface in contact with a grounded plate; and a coaxial feeder connected to said patch antenna section through both said grounded plate and said dielectric plate said coaxial feeder having a center conductive portion which penetrates said dielectric plate and is connected to a feeder point of said patch antenna section;

wherein said feeder point is located on said patch antenna section at a position deviated from a theoretical point of resonance of said patch antenna section such that the resonance frequency of said patch antenna section is set to a value higher than receive frequencies so that an inductive impedance component of said center conductive portion is substantially equal to a capacitive impedance component of the feeder point of said patch antenna portion over use frequencies.

2. The flat antenna defined in claim 1, wherein said patch antenna section comprises a circular conductive plate.

3. The flat antenna defined in claim 1, wherein said patch antenna section comprises a rectangular conductive plate.

* * * * *